US010297965B1

(12) United States Patent
Yang

(10) Patent No.: US 10,297,965 B1
(45) Date of Patent: May 21, 2019

(54) POWER SUPPLY DEVICE AND POWER TRANSFORMER WITH REPLACEABLE PLUG HEAD

(71) Applicant: Mobileconn Technology Co.,LTD, New Taipei (TW)

(72) Inventor: Chung-Kai Yang, New Taipei (TW)

(73) Assignee: MOBILECONN TECHNOLOGY CO., LTD, New Taipei (TW)

( * ) Notice: Subject to any disclaimer, the term of this patent is extended or adjusted under 35 U.S.C. 154(b) by 0 days.

(21) Appl. No.: 15/853,939

(22) Filed: Dec. 25, 2017

(51) Int. Cl.

| | |
|---|---|
| ***H01R 13/60*** | (2006.01) |
| ***H01R 31/06*** | (2006.01) |
| ***H01R 13/627*** | (2006.01) |
| ***H01R 24/68*** | (2011.01) |
| ***H01R 13/652*** | (2006.01) |
| ***H01R 27/00*** | (2006.01) |
| ***H01R 24/70*** | (2011.01) |
| *H01R 103/00* | (2006.01) |
| *H01R 13/24* | (2006.01) |
| *H01R 13/66* | (2006.01) |

(52) U.S. Cl.
CPC ..... *H01R 31/06* (2013.01); *H01R 13/6272* (2013.01); *H01R 13/652* (2013.01); *H01R 24/68* (2013.01); *H01R 24/70* (2013.01); *H01R 27/00* (2013.01); *H01R 13/24* (2013.01); *H01R 13/6675* (2013.01); *H01R 2103/00* (2013.01)

(58) Field of Classification Search
CPC .. H01R 2103/00; H01R 35/04; H01R 23/025; H01R 31/06; H01R 13/60; H01R 13/6675; H01R 27/00
USPC ..... 439/131, 171–173
See application file for complete search history.

(56) References Cited

U.S. PATENT DOCUMENTS

| | | | | |
|---|---|---|---|---|
| 6,592,386 | B2 * | 7/2003 | Teng | H01R 13/62 439/172 |
| 7,273,384 | B1 * | 9/2007 | So | H01R 13/447 439/172 |
| 7,658,625 | B2 * | 2/2010 | Jubelirer | H01R 31/065 439/131 |
| 8,708,722 | B1 * | 4/2014 | Walliser | H01R 13/6675 439/172 |
| 8,888,513 | B2 * | 11/2014 | Shi | H01R 31/06 439/131 |

(Continued)

*Primary Examiner* — Hien D Vu
(74) *Attorney, Agent, or Firm* — Li & Cai Intellectual Property (USA) Office

(57) ABSTRACT

A power supply device includes a power transformer and a plug head. The power transformer has a housing, a conducting socket, an outputting connector, and a power conversion circuit. The housing has a wedging wall, and a receptacle wall, and both corporately form a receiving portion. The wedging wall has a wedging seat. The receptacle wall has a connection opening for receiving the conducting socket therein. The power conversion circuit is electrically connected to the conducting socket and the outputting connector to output a conversed electrical power to the outputting connector. The plug head is replaceably connected to the receiving portion, and includes an outer cover and an inner cover. The outer cover has a prong unit electrically connected to the plug connector. The inner cover has a wedging slot and a plug connector plugged in the conducting socket. The wedging seat is wedged in the wedging slot.

7 Claims, 5 Drawing Sheets

(56) References Cited

U.S. PATENT DOCUMENTS 8,944,845 B2 * 2/2015 Yu ..... H01R 13/447
439/171

* cited by examiner

POWER SUPPLY DEVICE AND POWER TRANSFORMER WITH REPLACEABLE PLUG HEAD

BACKGROUND OF THE INVENTION

1. Field of the Invention

The present disclosure is related to a power supply device and a power transformer with a replaceable plug head. In particular, the present disclosure relates to a power supply device used to transform a voltage of an electric supply into another voltage, and the power supply device has a power transformer and a replaceable plug head.

2. Description of Related Art

Due to the population of portable electronic devices, such as mobile phone, tablet computer, notebook . . . etc., power supply devices with voltage transformation function are required more and more. The conventional power supply device usually is able to mate with one unchangeable plug. However, different nations or countries have different safety standards of electrical devices, so that the sockets are different. For example, China CCC standard, America UL standard, United Kingdom UK standard . . . etc. The plugs and sockets, which meet the various standards in those countries, are not able to be applied in another different standard certification.

The conventional stationary power plug is obviously unable to be adapted for the various nation standard certifications, so that the electronic devices are not internationalized. Some power supply devices add another adapting plug on the stationary power plug to be adapted for different power sockets. However, it not only increases the total volume, but also increases the manufacturing cost.

SUMMARY OF THE INVENTION

One of the objectives of the present disclosure is to provide a power supply device, which has a power transformer and a rechargeable plug head, the plug head is detachably plugged to the power transformer, so as be in compliance with different safety standards of electrical devices, and connectable to various plug heads for mating with different sockets.

In order to achieve the above objectives, according to one exemplary embodiment of the present disclosure, a power supply device is provided and includes a power transformer and a plug head. The power transformer has a housing, a conducting socket, an outputting connector, and a power conversion circuit. The housing has a wedging wall and a receptacle wall. The receptacle wall is substantially perpendicular to the wedging wall to corporately form a concave-shaped receiving portion. The wedging wall is protruded with a wedging seat. The receptacle wall is formed with a connection opening. The conducting socket is disposed in the connection opening. The power conversion circuit is disposed in the housing, and electrically connected to the conducting socket and the outputting connector, so as to output a conversed electrical power to the outputting connector. In addition, the plug head is replaceably disposed in the receiving portion. The plug head has an outer cover and an inner cover. The outer cover has a prong unit to connect an electrical power. The inner cover has one side configured with a wedging slot, and another side equipped with a plug connector. The prong unit electrically connects to the plug connector. The wedging seat of the power transformer is wedged in the wedging slot. The plug connector is plugged in the conducting socket of the power transformer.

In order to achieve the above objectives, the present disclosure also provides a power transformer with a replaceable plug head. The power transformer includes a housing, a conducting socket, an outputting connector, and a power conversion circuit. The housing has a wedging wall and a receptacle wall. The receptacle wall is substantially perpendicular to the wedging wall to corporately form a concave-shaped receiving portion. The wedging wall is protruded with a wedging seat. The receptacle wall is formed with a connection opening. The conducting socket is disposed in the connection opening. The power conversion circuit is disposed in the housing, and electrically connected to the conducting socket and the outputting connector, so as to output a conversed electrical power to the outputting connector. The plug head is replaceable disposed in the receiving portion.

Thus, the present disclosure has advantages as follows. The plug head of the present disclosure is replaceably jointed to the power transformer, so that the present disclosure can be mated with different plug heads for being compliance with various safety standards for electrical products. Thus, the electrical product of the present disclosure can be internationalized and the manufacturing cost can be reduced.

For further understanding of the present disclosure, reference is made to the following detailed description illustrating the embodiments and examples of the present disclosure. The description is for illustrative purpose only and is not intended to limit the scope of the claim.

DETAILED DESCRIPTION OF THE EXEMPLARY EMBODIMENTS

The aforementioned illustrations and following detailed descriptions are exemplary for the purpose of further explaining the scope of the present disclosure. Other objectives and advantages related to the present disclosure will be illustrated in the subsequent descriptions and appended drawings.

Figure 1:
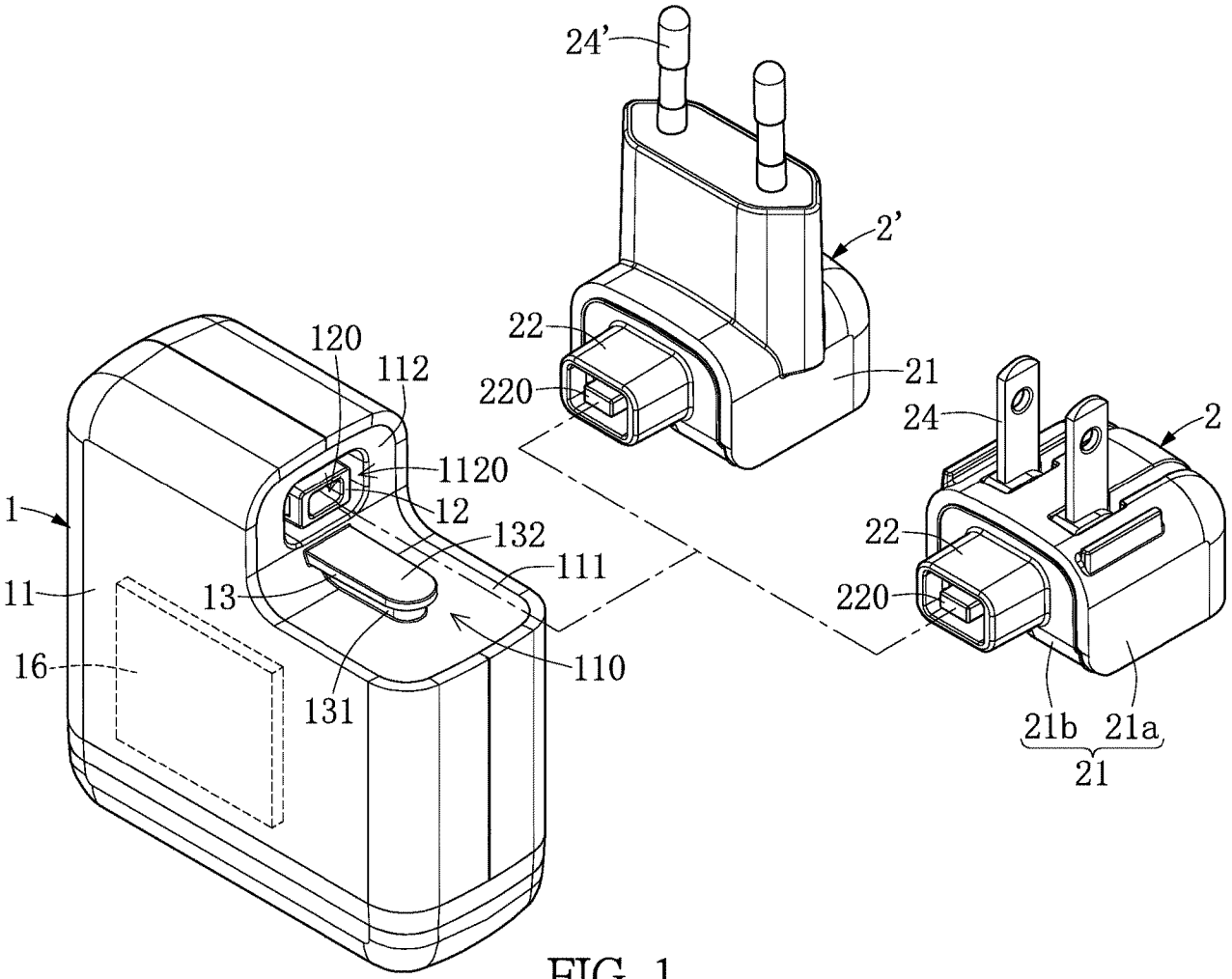
FIG. 1 is an exploded perspective view of a power supply device of the present disclosure.
Figure 2:
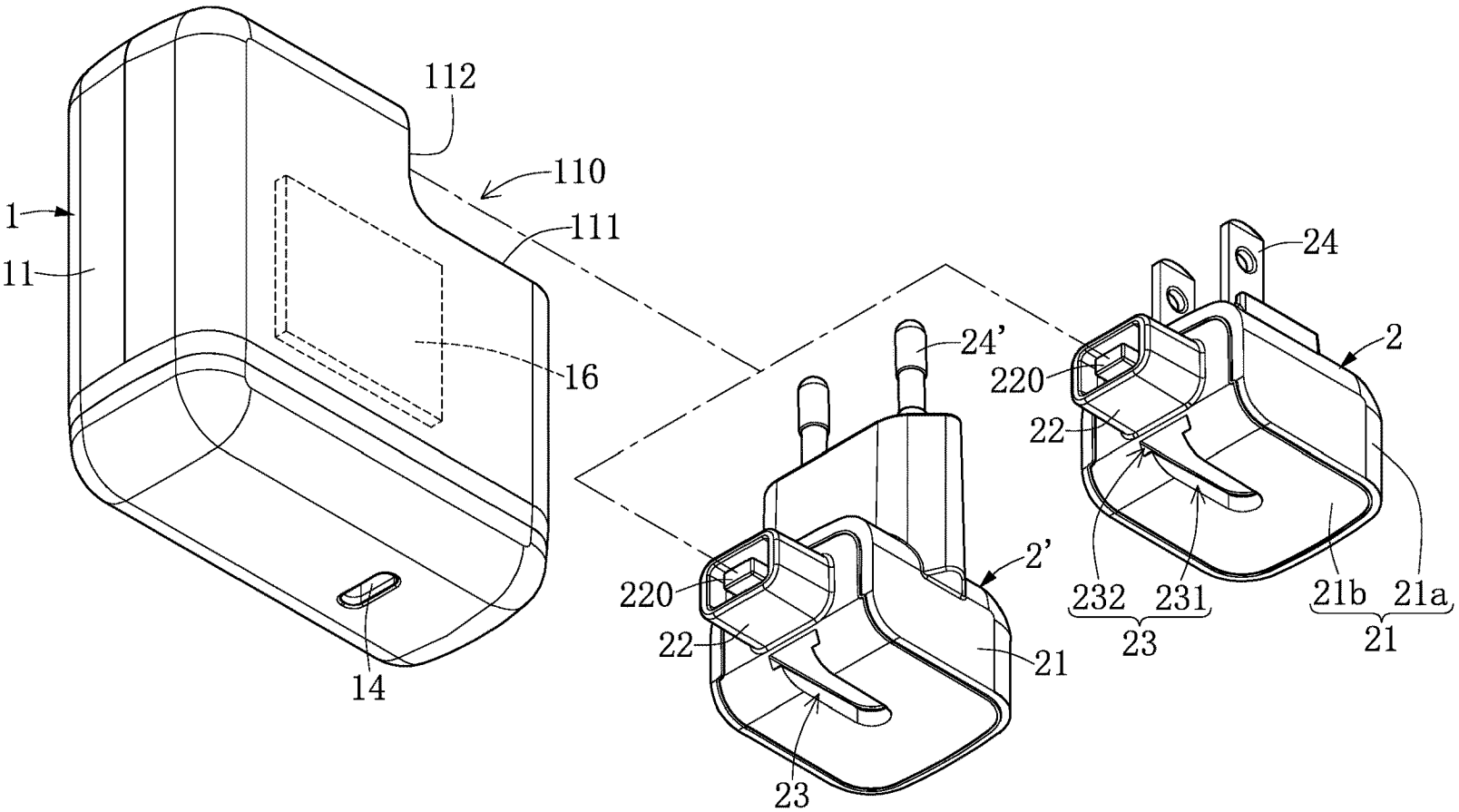
FIG. 2 is another exploded perspective of the power supply device of the present disclosure.

Reference is made to FIG. 1 and FIG. 2 which are different exploded perspective views of a power supply device according to the present disclosure. The present disclosure provides a power supply device 100 which includes a power transformer 1 and a plug head 2. The plug head 2 of this embodiment is replaceable, and the plug head 2 is detachably plugged to the power transformer 1, so as to replace a different plug head.

The power transformer 1 has a housing 11, a conducting socket 12, an outputting connector 14, and a power conversion circuit 16. A corner of the housing 11 has a wedging wall 111 and a receptacle wall 112. The receptacle wall 112 is substantially perpendicular to the wedging wall 111, and cooperatively form a concave-shaped receiving portion 110. The wedging wall 111 is protruded with a wedging seat 13. The receptacle wall 112 is formed with a connection opening 1120. The conducting socket 12 is disposed in the connection opening 1120. The power conversion circuit 16 is disposed in the housing 11, and electrically connected to the conducting socket 12 and the outputting connector 14, so as to transmit a conversed electrical power to the outputting connector 14.

In this embodiment, the plug head 2 is replaceably disposed in the receiving portion 110 of the power transformer 1. The plug head 2 has a mating housing 21. The mating housing 21 has an outer cover 21*a* and an inner cover 21*b*. The outer cover 21*a* has a prong unit 24 to connect a power source. The prong unit 24 of the plug head 2 has at least two prongs. This embodiment can be in compliance with different sockets of countries. For example, it can be replaced with the plug head 2' having a different prong unit 24', as shown in FIG. 1. Alternatively, it can be replaced with American standard UL electrical plug having two flat parallel prongs, UK Standard plug with three prongs, German GS standard plug with two round-pin prongs, or China CCC standard plug . . . etc.

The inner cover 21*b* of the plug head 2 has one side formed with a wedging slot 23, and another side equipped with a plug connector 22. The prong unit 24 is electrically connected to the plug connector 22. When the plug head 2 is plugged to the power transformer 1, the wedging seat 13 of the power transformer 1 is wedged in the wedging slot 23 of the plug head 2. The plug connector 22 of the plug head 2 is plugged in the conducting socket 12 of the power transformer 1.

In this embodiment, the joining structure between the plug head 2 and the power transformer 1 is illustrated as follows. The wedging seat 13 is substantially T-shaped from a front view thereof. The wedging seat 13 has a protrusion base 131 and a wing portion 132. The protrusion base 131 is protruded from the wedging wall 111 and extends to the receptacle wall 112. The wing portion 132 is connected to a top of the protrusion base 131. A width of the wing portion 132 is larger than a width of the protrusion base 131.

The wedging slot 23 has an outer slot 231 and an inner slot 232. The outer slot 231 is formed concavely on one side of the inner cover 21*b*. The inner slot 232 is formed inwardly from the outer slot 231. The protrusion base 131 is inserted in the outer slot 231, and the wing portion 132 is inserted in the inner slot 232.

Figure 3:
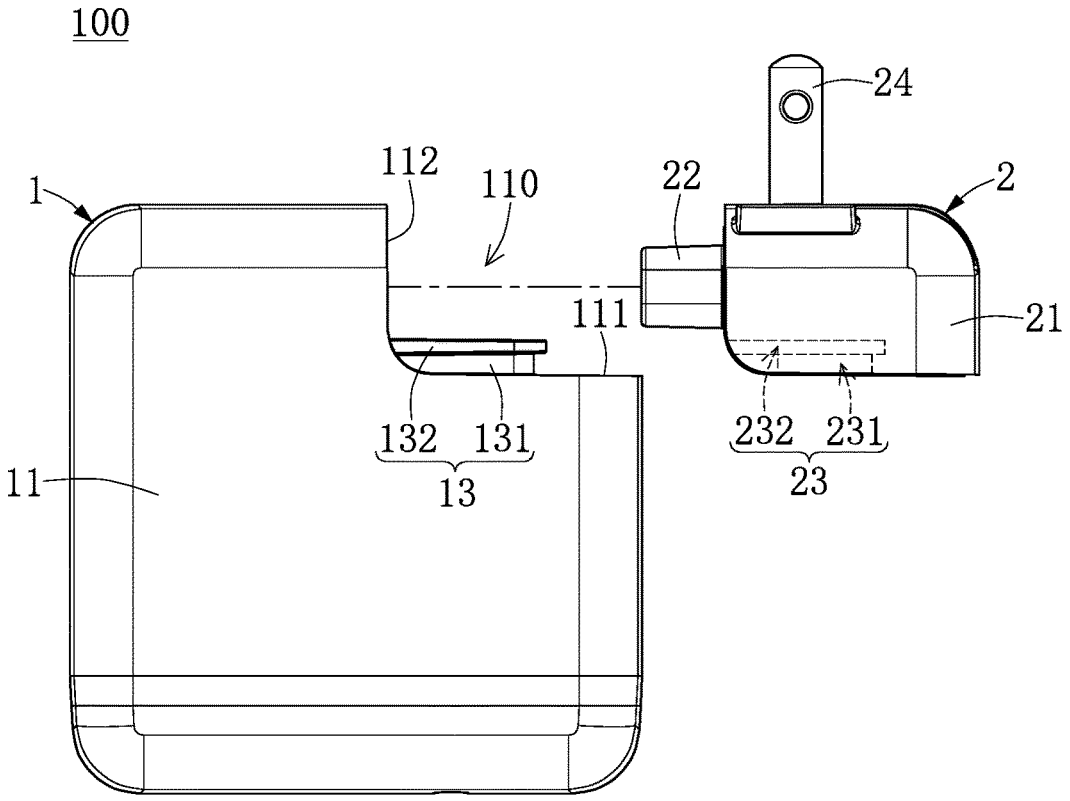
FIG. 3 is an exploded side view of the power supply device of the present disclosure.
Figure 4:
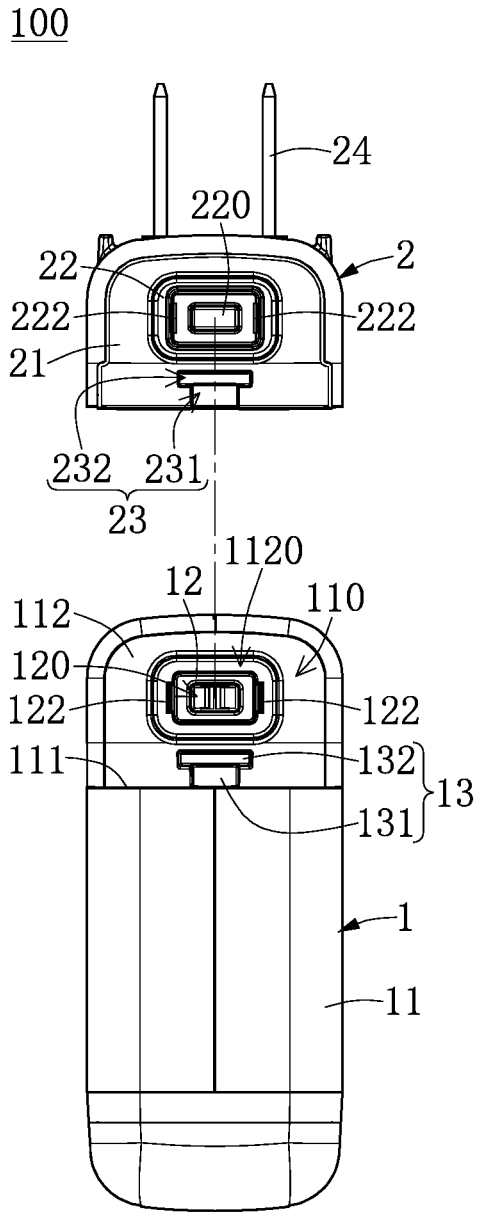
FIG. 4 is an exploded front view of the power supply device of the present disclosure.
Figure 5:
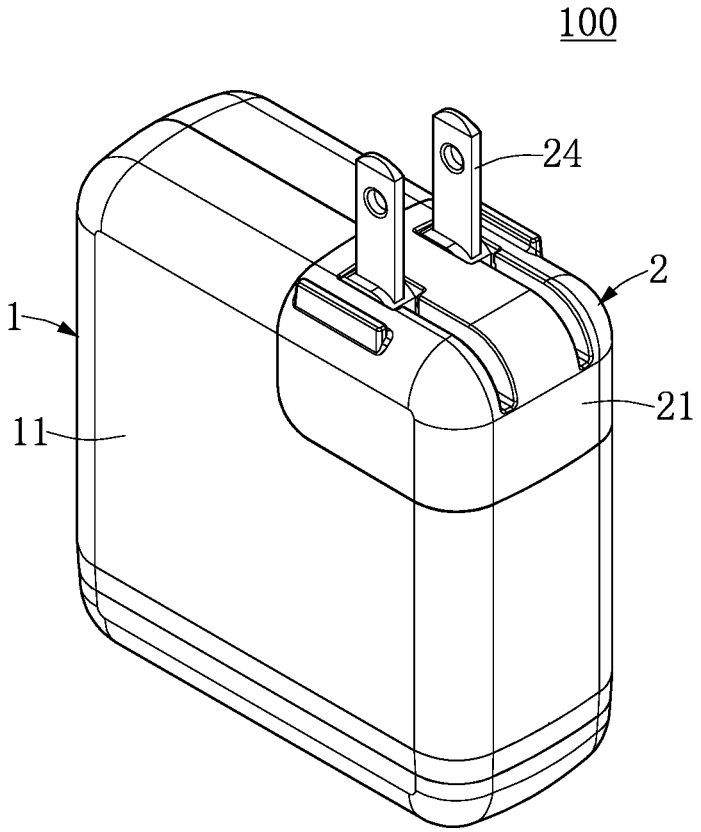
FIG. 5 is an assembled perspective view of power supply device of the present disclosure.

Note, in this embodiment, the length of the wedging seat 13 is longer than the length of the plug connector 22 along the inserting direction, such as the dash-dot line shown in FIG. 3. During the wedging seat 13 is inserting in the wedging slot 23, such structure can help the plug connector 22 being aimed to the conducting socket 12. Thus, the plug connector 22 can be guided to insert in the conducting socket 12.

The conducting socket 12 of this embodiment has a tongue sleeve 120 and a pair of conductive contacts 122. The pair of conductive contacts 122 is arranged at two outer sides of the tongue sleeve 120. The tongue sleeve 120 is shaped in a hollow tube. The plug connector 22 has a plugging tongue 220 and a pair of plugging contacts 222. The pair of plugging contacts 222 is arranged at two sides of the plugging tongue 220. When the plug connector 22 is plugged in the conducting socket 12, the plugging tongue 220 is inserted in the tongue sleeve 120. The pair of plugging contacts 222 are contacted with the pair of conductive contacts 122, respectively.

To sum up, the present disclosure has beneficial effects as follows. The power supply device of the present disclosure provides the plug head which is replaceably inserted in the power transformer, and is able to be complied with different safety standards of electrical devices, and connectable to various plug heads for mating with different sockets. Thus, the electrical product of the present disclosure can be internationalized and the manufacturing cost can be reduced.

The descriptions illustrated supra set forth simply the preferred embodiments of the present disclosure; however, the characteristics of the present disclosure are by no means restricted thereto. All changes, alterations, or modifications conveniently considered by those skilled in the art are deemed to be encompassed within the scope of the present disclosure delineated by the following claims.

What is claimed is:

1. A power supply device, comprising:

a power transformer, having:

a housing having a wedging wall and a receptacle wall formed with a connection opening and substantially perpendicular to the wedging wall to cooperatively form a concave-shaped receiving portion;

a conducting socket disposed in the connection opening;

an outputting connector;

a wedging seat protruding upwardly formed on the wedging wall; and a power conversion circuit disposed in the housing and electrically connected to the conducting socket and the outputting connector, so as to output a conversed electrical power to the outputting connector; and a plug head, for being replaceably plugged in the receiving portion along a plugging direction, and having:

an outer cover having a prong unit for connecting an electrical power; and an inner cover having one side formed with a wedging slot for wedgingly receiving the wedging seat, and another side formed with a plug connector for being plugged in the conducting socket, the plug connector being electrically connected to the prong unit, wherein the wedging seat extends upwardly from the receptacle wall along the plugging direction and has a protrusion base and a wing portion, a length of the wedging seat along the plugging direction is larger than a length of the plug connector along the plugging direction, and when the plug head is being plugged into the power transformer, the wedging seat of the power transformer is ahead wedged into the wedging slot of the plug head, the plug connector of the plug head is continuously guided to move along the plugging direction on the wedging seat until the plug connector is plugged in the conducting socket.

2. The power supply device as claimed in claim 1, wherein the protrusion base is protrudingly formed on the wedging wall and extends toward the receptacle wall along the plugging direction, the wing portion being connected to a top end of the protrusion base, and a width of the wing portion being larger than a width of the protrusion base.

3. The power supply device as claimed in claim 2, wherein the wedging slot has an outer slot and an inner slot, the outer slot is inward concavely formed from a side of the inner cover, the inner slot is formed at an inner side of the outer slot, the protrusion base is wedged in the outer slot, and the wing portion is wedged in the inner slot.

4. The power supply device as claimed in claim 1, wherein the prong unit of the plug head has at least two prongs.

5. The power supply device as claimed in claim 1, wherein the conducting socket has a tongue sleeve and a pair of conductive contacts, the pair of conductive contacts being respectively located at two outer sides of the tongue sleeve, and the tongue sleeve is hollow-shaped.

6. The power supply device as claimed in claim 5, wherein the plug connector has a plugging tongue and a pair of plugging contacts, the pair of plugging contacts being respectively located at two sides of the plugging tongue, and when the plug connector is plugged to the conducting socket, the plugging tongue is plugged in the tongue sleeve.

7. A power transformer for connecting with a replaceable plug head, the power transformer comprising:

a housing having a wedging wall and a receptacle wall formed with a connection opening and substantially perpendicular to the wedging wall to cooperatively form a concave-shaped receiving portion for receiving the replaceable plug head;

a conducting socket disposed in the connection opening;

an outputting connector;

a wedging seat protruding upwardly formed on the wedging wall; and a power conversion circuit disposed in the housing, and connected to the conducting socket and the outputting connector, so as to output a conversed electrical power to the outputting connector, wherein the wedging seat extends from the receptacle wall along a plugging direction of the plug head in the receiving portion and has a protrusion base and a wing portion, and is configured to be ahead wedged into a wedging slot of the plug head when the plug head is being plugged into the power transformer, so that a plug connector of the plug head is continuously guided to move along the plugging direction on the wedging seat until the plug connector is plugged in the conducting socket.

* * * * *